United States Patent [19]

Koyama et al.

[11] Patent Number: 4,558,443

[45] Date of Patent: Dec. 10, 1985

[54] MOVING COIL TYPE PICKUP CARTRIDGE

[75] Inventors: Etsuo Koyama; Kazuhiro Nakamura, both of Tokyo, Japan

[73] Assignee: Tekudaiya Kabushiki Kaisha, Japan

[21] Appl. No.: 422,215

[22] Filed: Sep. 23, 1982

[51] Int. Cl.[4] ..... H04R 9/16

[52] U.S. Cl. ..... 369/139; 369/147; 369/172

[58] Field of Search ..... 369/139, 147, 148, 171, 369/172

[56] References Cited

U.S. PATENT DOCUMENTS 4,364,120 12/1982 Honma ..... 369/147

FOREIGN PATENT DOCUMENTS 56-68100 6/1981 Japan ..... 369/147

57-26990 2/1982 Japan ..... 369/139

*Primary Examiner*—Donald McElheny, Jr.

*Attorney, Agent, or Firm*—Oldham, Oldham & Weber Co.

[57] ABSTRACT

An improved pickup cartridge of the kind including two moving coils is disclosed which is constructed such that a cantilever including a stylus tip at its foremost end is inclinably held by means of a damping rubber fixedly fitted into a longitudinally extending hole in a cartridge case which is preferably divided into two case halves and a pair of coils are wound about the cantilever which are located opposite to one another relative to the damper rubber disposed therebetween. An assembly of a magnet and yokes is fixedly held in the cartridge case so as to generate two magnetic fields which are directed at a right angle relative to one another, one of them being located corresponding to one of the coils and the other one being located corresponding to the other coil. Preferably, an assembly including the cantilever, the coils and the damper rubber is fitted into a sleeve and the latter is inserted in the longitudinally extending hole in the cartridge case. The damper rubber serves as a fulcrum for vibratory inclination of the cantilever. The coils are preferably wound about tubular magnetic cores which are fitted onto the cantilever. The yokes are bent and bifurcated at their upper part to form two gaps between the inclined extensions thereof so as to generate the magnetic fields by means of the magnet.

5 Claims, 5 Drawing Figures

MOVING COIL TYPE PICKUP CARTRIDGE

BACKGROUND OF THE INVENTION

The present invention relates to an improved moving coil type pickup cartridge and more particularly to a pickup cartridge of the kind having two moving coils for acoustic recording and reproducing.

As is well known, a conventional moving coil type pickup cartridge (hereinafter referred to simply as MC type pickup cartridge) is generally constructed such that a cantilever is operatively connected to coils by way of connecting links and the coils are wound about coil bobbins. However, it has been found that the above-mentioned arrangement causes reduction in output from the coils and thus the whole pickup cartridge is manufactured at an expensive cost due to its complicated structure. Another drawback with respect to the conventional pickup cartridge is that there is necessity for replacing the whole pickup cartridge with new one when a stylus tip becomes worn off. Moreover, complicated readjustment is required after completion of replacement.

SUMMARY OF THE INVENTION

The present invention is intended to obviate the drawbacks inherent to the conventional MC type pickup cartridge as described above. The improvement of the present invention consists in that a cantilever including a stylus tip as its foremost end is inclinably held by means of a resilient holding means in the form of a damper rubber fixedly fitted into a longitudinally extending hole in a cartridge case which is divided into two case halves and a pair of coils are wound about the cantilever which are located opposite to one another relative to the resilient holding means disposed therebetween. One of the case halves serves as a knob and the other one is a rear case half in which an assembly of a magnet and two yokes is fixedly held by embedding or the like process.

In a preferred embodiment of the invention an assembly including a cantilever, coils and a resilient holding means is firmly fitted into a sleeve adapted to be inserted in the longitudinally extending hole in the cartridge case. Preferably, the sleeve and the corresponding hole have a square cross-sectional configuration respectively. The resilient holding means serves as a fulcrum for vibratory inclination of the cantilever.

In another preferred embodiment of the invention the coils are wound about tubular magnetic members which serve as a core, said tubular magnetic members being fitted onto the cantilever.

An assembly of a magnet and two yokes is fixedly held in the cartridge case so as to generate two magnetic field which are directed at a right angle relative to one another, one of the two magnetic fields being located corresponding to one of the coils and the other one being located corresponding to the other coil. The magnet is disposed between the lower parts of the yokes and the latter are bent and bifurcated at the upper parts thereof so as to form two gaps between their inclined extensions, said gaps being directed at a right angle relative to one another, so that the two magnetic fields are generated by means of the magnet.

The two case halves are removably engaged to one another by means of terminal pins and corresponding fitting holes by way of which output from the coils is transmitted to terminal means at the rear part of the cartridge case. Output from the coils is delivered to an amplifier in a record player or the like via the terminal means.

Hence, it is an object of the present invention to provide an improved MC type pickup cartridge which makes it possible to simplify the structure of an assemble including a cantilever, coils and others without any risk of reducing output from the coils.

It is other object of the present invention to provide a MC type pickup cartridge which does not require replacement of the whole pickup cartridge when a stylus tip becomes worn off.

It is another object of the present invention to provide a MC type pickup cartridge which requires no complicated readjustment after completion of partial replacement of the cartridge case.

It is further another object of the present invention to provide a MC type pickup cartridge which can be easily operated by any unskilled person.

It is still another object of the present invention to provide a MC type pickup cartridge which is simple in structure and thus can be manufactured at an inexpensive cost.

Other objects and advantageous features of the invention will be readily understood from the reading of the following description made in conjunction with the accompanying drawings.

BRIEF DESCRIPTION OF THE DRAWINGS

The accompanying drawings will be briefly described hereunder.

DETAILED DESCRIPTION OF THE INVENTION

Now the present invention will be described in a greater detail with reference to the accompanying drawings which illustrate a preferred embodiment of the present invention.

Figure 1:
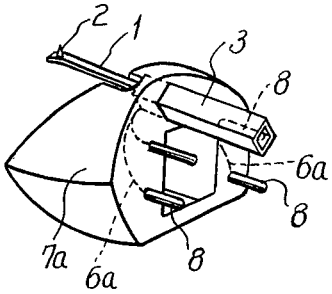
FIG. 1 is a perspective view of a knob constituting a fore case half of a cartridge case for a pickup cartridge in accordance with a preferred embodiment of the invention.
Figure 3:
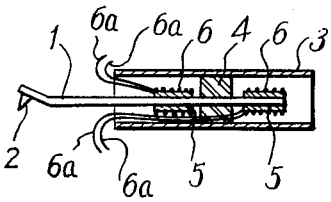
FIG. 3 is a vertical sectional view of an assembly including a cantilever, coils and others which is to be inserted in the pickup cartridge, shown in an enlarged scale.

Referring first to FIGS. 1 and 3, reference numeral 1 designates a cantilever which includes a stylus tip 2 fixedly secured to the foremost end thereof. The cantilever 1 is made of non-magnetic material such as aluminum, duralmin, titanium, berylium alloy or the like. Reference numeral 3 designates a sleeve made of the same or similar material to that of the cantilever 1. In the illustrated embodiment the sleeve 3 is designed in the form of a tube having a square cross-sectional configuration but it may be designed in other type of tube, for instance, a tube having a circular cross-sectional configuration. A damper rubber 4 made of resilient material such as butyl rubber or the like is firmly fitted into the sleeve 3 so as to hold the stem of the cantilever 1 in such a manner as to incline the latter within a limited extent. The damper rubber 4 is firmly located about at the middle part of the sleeve 3. Further, the cantilever 1 is fitted with a pair of tubular cores 5 made of magnetic material, said tubular cores 5 being located opposite to one another relative to the damper rubber 4 disposed therebetween and coils 6 are wound about the tubular cores 5. The sleeve 3 including the cantilever 1, the damper rubber 4, the pair of tubular cores 5 and the pair of coils 6 in the above-described manner is inserted through a knob *7a* which constitutes a fore case half of a cartridge case until the rear part of the sleeve 3 is projected backward at a certain distance from the abutment surface thereof, as illustrated in FIG. 1. The knob *7a* is made of the same synthetic resin as that of a rear case half 7 by way of injection molding process or the like. As will be described later, the knob *7a* may be molded integrally with the rear case half 7. Reference numeral 8 designates a plurality of terminal pins which are projected from the rear surface of the knob *7a* in the same direction as the sleeve 3. As illustrated by dotted lines in FIG. 1, lead wires *6a* extend from the pair of coils 6 in the knob *7a* and they are connected to the inside end of the respective terminal pins 8.

Figure 2:
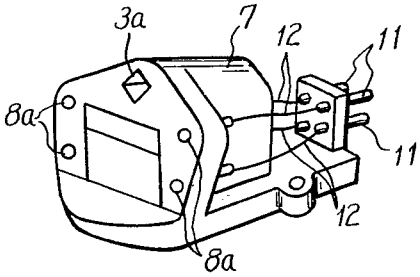
FIG. 2 is a perspective view of a rear case half to which the knob in FIG. 1 is to be removably engaged.
Figure 4:
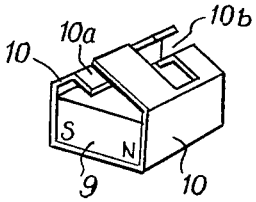
FIG. 4 is a perspective view of an assembly of a magnet and two yokes, shown in an enlarged scale.

FIG. 2 illustrates a rear case half 7 constituting a rear part of the cartridge case by way of a perspective view to which the knob *7a* is adapted to be removably engaged. The rear case half 7 includes a permanent magnet 9 and a pair of yokes 10 as illustrated in FIG. 4 and the assembly of the magnet 9 and the yokes 10 is firmly held in a predetermined position in the rear case half 7 by embedding or the like process. As is apparent from FIG. 2, a receiving square hole *3a* and a plurality of fitting holes *8a* are formed in the rear case half 7 so that the projected part of the sleeve 3 is received in the former and the corresponding terminal pins 8 on the knob *7a* are fitted into the latter. Thus, the knob *7a* is firmly engaged to the rear case half 7 by inserting the projected part of the sleeve 3 in the receiving hole *3a* and fitting the terminal pins 8 into the corresponding fitting holes *8a* whereby induced voltage is transmitted from the coils 6 to terminal pins 11 on the rear case half 7 via the terminal pins 8 on the knob *7a*.

As is apparent from FIG. 4, the yokes 10 have two pairs of inclined extensions which are directed and dimensioned so that gaps *10a* and *10b* are formed between the pair of oppositely located inclined extensions and both the coils 6 are located in the gaps *10a* and *10b* when the knob *7a* is firmly engaged to the rear case half 7. Specifically, the pair of yokes 10 hold the magnet 9 between their lower parts and they are bent and bifurcated at their upper part so as to form the aforesaid two gaps *10a* and *10b* which are directed at a right angle relative to one another. Thus, both the coils 6 are disposed in two magnetic fields which are directed at a right angle relative to one another when the sleeve 3 is inserted in the receiving hole *3a*.

Next, operation of the pickup cartridge constructed in the above-mentioned manner will be described below.

Figure 5:
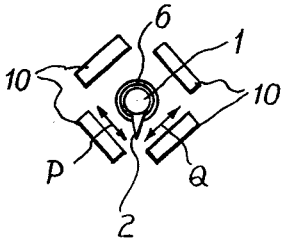
FIG. 5 is a schematic front view illustrating operation of the pickup cartridge.

While the stylus tip 2 is brought in sliding contact with grooves on a recording disc (not shown), the cantilever 1 is caused to vibrate in the direction as identified by reference letter P or Q in FIG. 5. The characteristic feature of the pickup cartridge of the invention consists in that vibration is caused in the form of inclinable movement of the cantilever 1 about the damper rubber 4 which serves as a fulcrum for vibratory movement of the cantilever 1. The respective coils 6 on the cantilever 1 generate induced voltage in one of the magnetic fields corresponding to a specific direction of vibration respectively when vibration is caused in the aforesaid specific direction. Induced voltage is transmitted to the terminal pins 11 on the rear case half 7 via the lead wires *6a*, the terminal pins 8 on the knob *7a*, the corresponding fitting holes *8a* in the rear case half 7 and the lead wires 12 connected to the rear end of the fitting holes *8a* and it is then delivered to an amplifier in a recording player or the like (not shown).

In the illustrated embodiment the terminal pins 8 for ensuring engagement of the knob *7a* to the rear case half 7 are projected from the former. Alternatively, the terminal pins 8 may be projected from the rear case half 7 and the corresponding fitting holes may be formed on the rear surface of the knob *7a*.

Further, in the illustrated embodiment the rear case half 7 and the knob *7a* are molded separately. Alternatively, they may be molded integrally. In this case the terminal pins 8 and the corresponding fitting holes *8a* are not required and the lead wires 6 extending from the coils 6 are connected directly to the terminal pins 11 on the rear case half 7.

Now the advantageous features of the MC type pickup cartridge in accordance with the invention will be noted below.

(a) Owing to the arrangement that the coils 6 are wound about the cantilever 1 in the form of a rod the structure of the assembly including the cantilever 1 and others becomes very simple, resulting in easy manufacturing at an inexpensive cost.

(b) Since it is possible to change an elastic module of the damper rubber 4 by changing compression force given to it by means of the coils 6 located opposite to one another relative to the damper rubber 4 disposed therebetween, it is simple to determine an amount of displacement of the cantilever 1 in the optimum manner.

(c) Owing to the arrangement that the coils 6 are wound about the tubular magnetic cores 5 fitted onto the cantilever 1 it becomes easier to manufacture the assembly including the cantilever 1 and others. The coils 6 are located before and behind the damper rubber 4 which serves as a fulcrum for vibratory inclination of the cantilever 1 and have a comparatively small amount of displacement. However, there is no fear of causing reduction in output from the coils 6 due to the fact that they are wound about the tubular magnetic members 5 which serve as a core.

(d) Owing to the arrangement that the cantilever 1 is held in the sleeve 3 by means of the damper rubber 4 firmly fitted into the sleeve 3 and the assembly including the cantilever 1 and others is inserted in the cartridge case 7 (*7a*) it is very easy to manufacture the whole assembly of the pickup cartridge.

(e) Since the yokes 10 are specially designed so as to generate two magnetic fields which are directed at a right angle relative to one another, it is possible to construct the whole pickup cartridge in very small dimensions.

(f) Since the knob *7a* including the cantilever 1, the coils 6 and others is removably engaged to the rear case half 7, the MC type pickup cartridge of the invention can be put in use again merely by partial replacement when the stylus tip 2 becomes worn off and moreover replacement operation can be carried out very easily.

Finally, it should be noted that the subject invention has been described above merely with respect to the illustrated embodiment but it should be not limited only to this and various changing or modification may be made without any departure from the spirit and scope of the invention.

What is claimed is:

1. A pickup cartridge of the kind of including two moving coils for acoustic recording and reproducing comprising in combination;

a cartridge case having a longitudinally extending hole at its upper part, a cantilever in the form of a rod including a stylus tip at its foremost end, said cantilever being inclinable within a limited extent in said longitudinally extending hole in the cartridge case, a resilient holding means in the form of a damper rubber made of resilient material, said resilient holding means being firmly fitted into the longitudinally extending hole in the cartridge case in such a manner that it serves as a fulcrum for vibratory inclination of the cantilever so as to inclinably hold the latter, a pair of coils wound about the cantilever, said coils being located opposite to one another relative to the resilient holding means disposed therebetween, a pair of yokes including a permanent magnet disposed between their lower parts so as to generate two magnetic fields which are directed at a right angle relative to one another at their upper part, one of the magnetic fields being located corresponding to one of the coils and the other one being located corresponding to the other coil, said yokes and said magnet being fixedly held in the cartridge case by embedding or the like process, and terminal means disposed at the rear part of the cartridge case, said terminal means being in electrical connection with the coils on the cantilever via the lead wires so as to deliver output from the coils to an amplifier in a record player or the like.

2. A pickup cartridge as defined in claim 1, wherein the assembly including the cantilever, the coils and the resilient holding means is firmly fitted into a sleeve which is adapted to be inserted in the longitudinally extending hole in the cartridge case.

3. A pickup cartridge as defined in claim 1 or 2, wherein the coils extend longitudinally of said cantilever and are wound about tubular magnetic members which serve as a core, said tubular magnetic members being fitted into the cantilever.

4. A pickup cartridge as defined in claim 1, wherein the cartridge case is divided into two parts, one of them being a fore case half which serves as a knob and the other one being a rear case half in which the assembly of the magnet and the yokes is fixedly held, said two case halves being removably engaged to one another by means of terminal pins and corresponding holes by way of which output from the coils is transmitted to the terminal means at the rear part of the cartridge case.

5. A pickup cartridge as defined in claim 1, wherein the yokes are bent and bifurcated at their upper part so as to form two gaps between the inclined extensions of the latter, said gaps being directed at a right angle relative to one another, so that the two magnetic fields are generated by means of the magnet.

* * * * *